US010248067B2

(12) United States Patent
Fukuma

(10) Patent No.: US 10,248,067 B2
(45) Date of Patent: Apr. 2, 2019

(54) IMAGE FORMING APPARATUS INCLUDING COOPERATING MEMBER THAT MOVES TO AN ACTIVATED POSITION WHERE COOPERATING MEMBER IS ENABLED TO COOPERATE WITH COVER WHEN COVER IS OPENED FOR FIRST TIME AFTER DELIVERY OF IMAGE FORMING APPARATUS

(71) Applicant: KYOCERA Document Solutions Inc., Osaka (JP)

(72) Inventor: Nobuhiro Fukuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/924,366

(22) Filed: Mar. 19, 2018

(65) Prior Publication Data

US 2018/0284679 A1 Oct. 4, 2018

(30) Foreign Application Priority Data

Mar. 28, 2017 (JP) ..... 2017-063701

(51) Int. Cl.
*G03G 15/00* (2006.01)
*G03G 21/16* (2006.01)
*G03G 15/08* (2006.01)

(52) U.S. Cl.
CPC ..... *G03G 15/55* (2013.01); *G03G 21/1633* (2013.01); *G03G 15/0865* (2013.01); *G03G 2215/0687* (2013.01); *G03G 2221/163* (2013.01); *G03G 2221/1648* (2013.01)

(58) Field of Classification Search
CPC ..... G03G 15/55
USPC ..... 399/114
See application file for complete search history.

(56) References Cited

U.S. PATENT DOCUMENTS 6,783,231 B1 * 8/2004 Kim ..... B41J 29/13 347/108
7,386,252 B2 * 6/2008 Portig ..... B41J 29/02 399/110
8,107,854 B2 * 1/2012 Jang ..... G03G 21/1633 399/110
2010/0054801 A1 * 3/2010 Kitamura ..... B41J 29/13 399/114

(Continued)

FOREIGN PATENT DOCUMENTS

JP 2004-157254 A 6/2004

*Primary Examiner* — Quana Grainger
(74) *Attorney, Agent, or Firm* — Studebaker & Brackett PC

(57) ABSTRACT

An image forming apparatus includes a cover, a cooperating member, a switching member, a detector, and a controller. The cover opens and closes an aperture in a main body of the image forming apparatus. The cooperating member moves to an activated position when the cover is opened for the first time. The activated position is a position where the cooperating member is enabled to cooperate with the cover. The switching member moves in cooperation with the cover through the cooperating member in the activated position as the cover is opened and closed. The detector detects an open state or a closed state of the cover according to the movement of the switching member. The controller determines that image formation is enabled when the detector has detected the closed state of the cover.

4 Claims, 16 Drawing Sheets

(56) References Cited

U.S. PATENT DOCUMENTS

2015/0185686 A1* 7/2015 Matsuno ..... G03G 21/1633
399/110

* cited by examiner

IMAGE FORMING APPARATUS INCLUDING COOPERATING MEMBER THAT MOVES TO AN ACTIVATED POSITION WHERE COOPERATING MEMBER IS ENABLED TO COOPERATE WITH COVER WHEN COVER IS OPENED FOR FIRST TIME AFTER DELIVERY OF IMAGE FORMING APPARATUS

INCORPORATION BY REFERENCE

The present application claims priority under 35 U.S.C. § 119 to Japanese Patent Application No. 2017-063701, filed on Mar. 28, 2017. The contents of this application are incorporated herein by reference in their entirety.

BACKGROUND

The present disclosure relates to an image forming apparatus having a cover for opening and closing an aperture in a main body of the image forming apparatus.

In one example of an image forming apparatus, a toner container containing a toner that is supplied to a developing device is attached to and detached from the image forming apparatus through a toner container mounting aperture in a main body of the image forming apparatus. The toner container mounting aperture is openable and closable by a cover.

The image forming apparatus may be shipped with the toner container attached thereto. A film is attached to a toner replenishment inlet of the toner container to prevent toner leakage in case of drop or vibration during shipping and transportation. The film needs to be removed after delivery of the image forming apparatus, which however is often forgotten.

In order to prevent a failing to remove such a film, the image forming apparatus may be provided with a label covering a power switch thereof. The label extends to the toner container mounting aperture under the cover so as to span the attached toner container. A message in the form of text, picture, or the like that prompts removal of the film is printed on the label. That is, removal of the film is prompted by necessitating opening the cover and viewing the message to prevent a failing to remove the film.

SUMMARY

An image forming apparatus according to an aspect of the present disclosure includes a cover, a cooperating member, a switching member, a detector, and a controller. The cover opens and closes an aperture in a main body of the image forming apparatus. The cooperating member moves to an activated position when the cover is opened for the first time after delivery of the image forming apparatus. The activated position is a position where the cooperating member is enabled to cooperate with the cover. The switching member moves in cooperation with the cover through the cooperating member in the activated position as the cover is opened and closed. The detector detects an open state or a closed state of the cover according to the movement of the switching member. The controller determines that image formation is enabled when the detector has detected the closed state of the cover.

DETAILED DESCRIPTION

The following describes an image forming apparatus according to an embodiment of the present disclosure with reference to the accompanying drawings.

Figure 1:
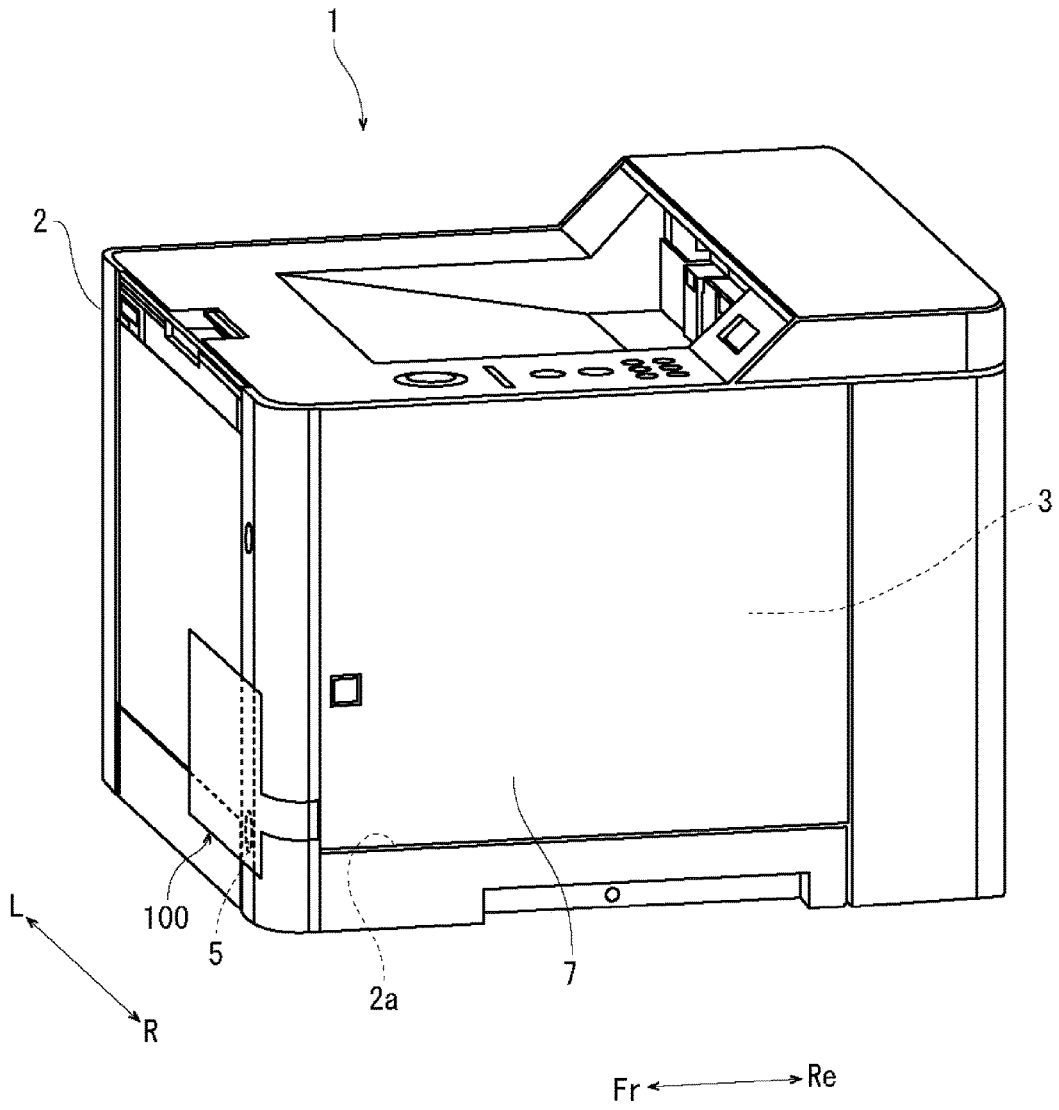
FIG. 1 is a perspective view illustrating a color printer according to an embodiment of the present disclosure.
Figure 2:
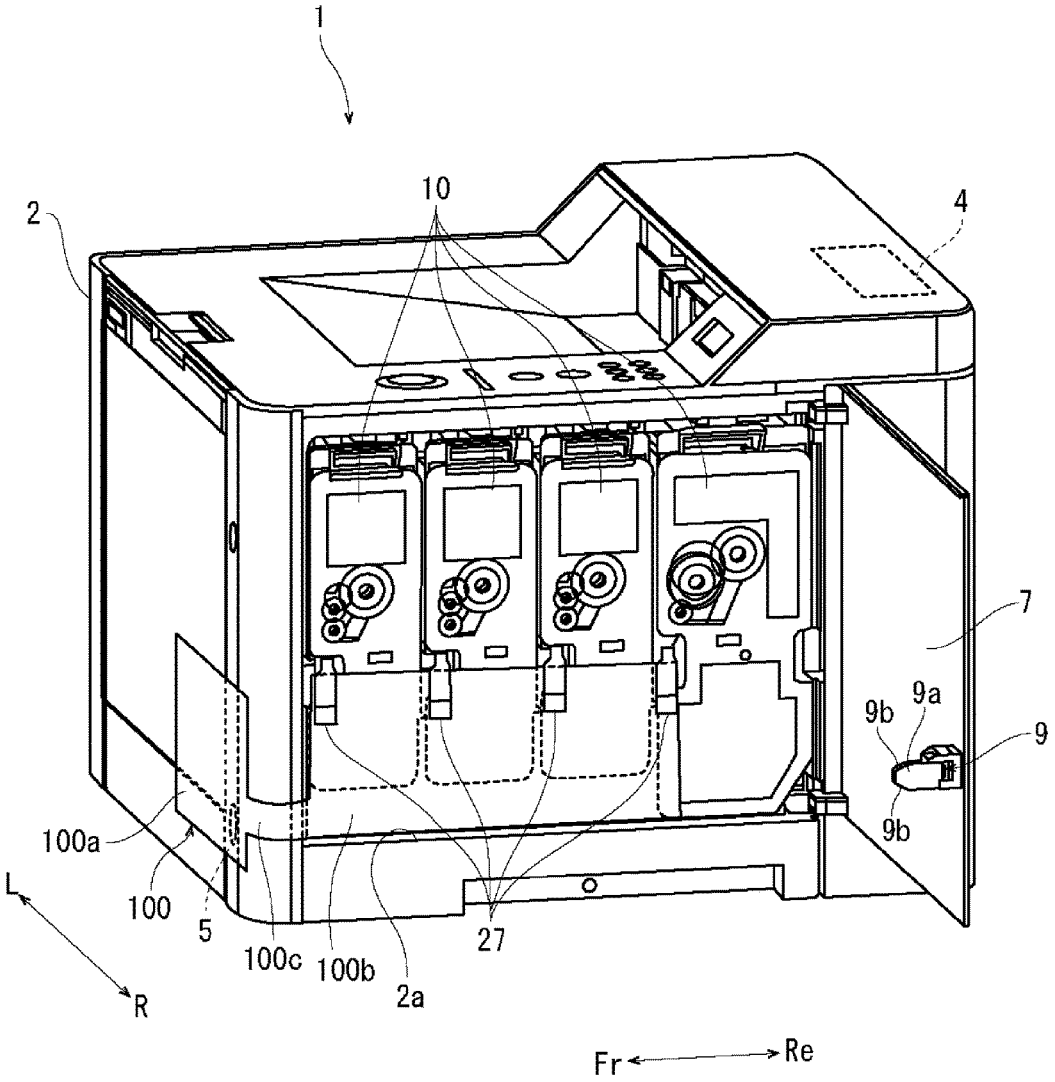
FIG. 2 is a perspective view illustrating a toner container mounting aperture in the color printer according to the embodiment of the present disclosure with a cover thereof open.
Figure 3:
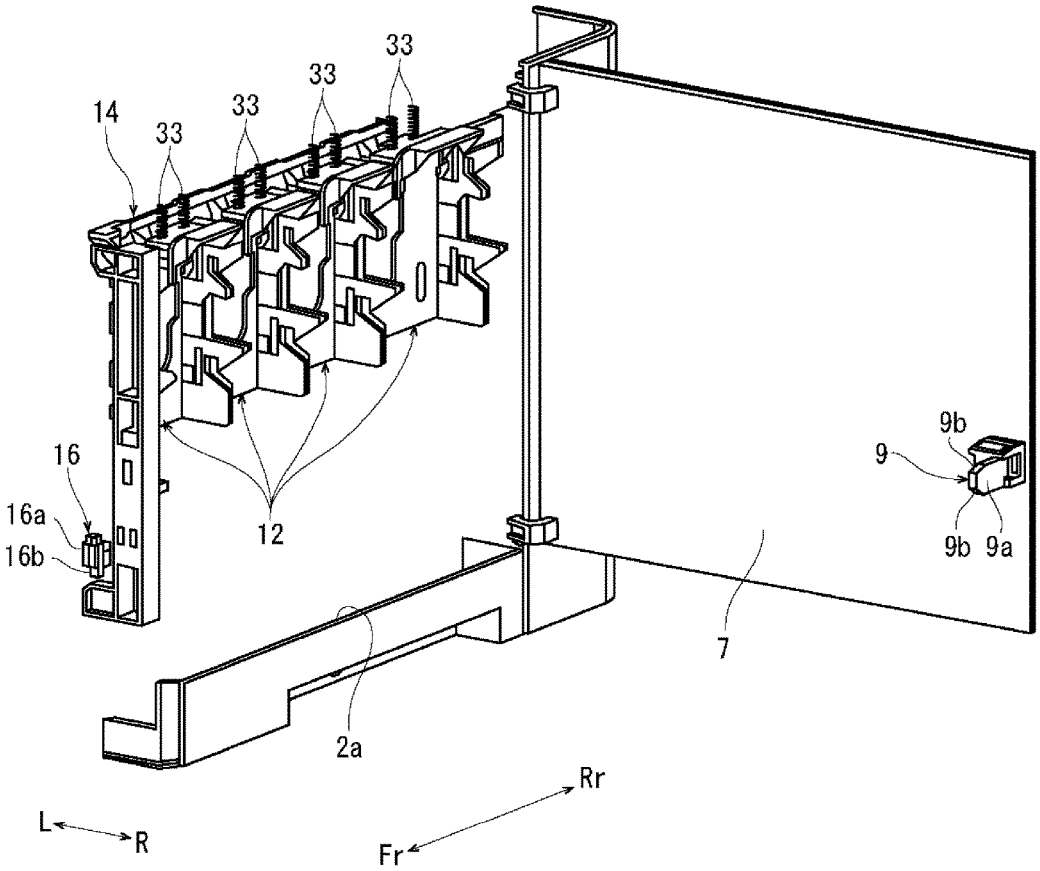
FIG. 3 is a perspective view illustrating the inside of the toner container mounting aperture in the color printer according to the embodiment of the present disclosure.

A color printer 1, which is an image forming apparatus, will be described with reference to FIGS. 1 to 3. FIG. 1 is a perspective view illustrating the color printer 1. FIG. 2 is a perspective view illustrating the color printer 1 when a cover 7 of a toner container mounting aperture 2*a* is open. FIG. 3 is a perspective view illustrating the inside of the toner container mounting aperture 2*a*. Hereinafter, a front-rear direction of the color printer 1 is defined as a front (Fr)-rear (Rr) direction shown in FIG. 1, and a left (L)-right (R) direction is defined based on the color printer 1 viewed from the front side.

A main body 2 of the color printer 1 includes an image forming section 3 and a controller 4. The image forming section 3 performs image formation on paper by electrophotography using toners of four colors (yellow (Y), magenta (M), cyan (C), and black (K)). The controller 4 causes the image forming section 3 to execute an image formation operation.

A power switch 5 is provided at a right end of a front face of the main body 2. The power switch 5 switches the image forming section 3 between an image formation disabled state and an image formation enabled state. A right face of the main body 2 has a horizontally long rectangular aperture 2*a*. As illustrated in FIG. 2, the aperture 2*a* is a toner container mounting aperture. The toner container mounting aperture 2*a* is an opening through which toner containers 10 described below are attached and detached. The toner container mounting aperture 2*a* is openable and closable by the cover 7. The cover 7 is supported by a rear edge of the toner container mounting aperture 2*a* so as to be pivotable in a horizontal direction. An inner surface of the cover 7 has a protrusion 9 protruding from a front portion thereof. The protrusion 9 is a narrow rectangular parallelepiped. The protrusion 9 has a substantially vertical outer surface 9*a* and upper and lower tapered surfaces 9*b* at upper and lower edges. The outer surface 9*a* is a first pushing surface extending in a direction (vertical direction) intersecting with a pivoting direction of the cover 7. The upper and lower tapered surfaces 9*b* are second pushing surfaces respectively inclined downward and upward in a closing direction of the cover 7.

As illustrated in FIG. 3, container holders 12, a switching member 14, and a detector 16 are provided inside the toner container mounting aperture 2*a*. The toner containers 10 are attached to the respective container holders 12. The container holders 12 are movable members supported so as to move in a specific direction as a result of the respective toner containers 10 being attached thereto. The switching member 14 moves as the cover 7 is opened and closed. The detector 16 detects an open state or a closed state of the cover 7 according to the movement of the switching member 14.

Figure 4:
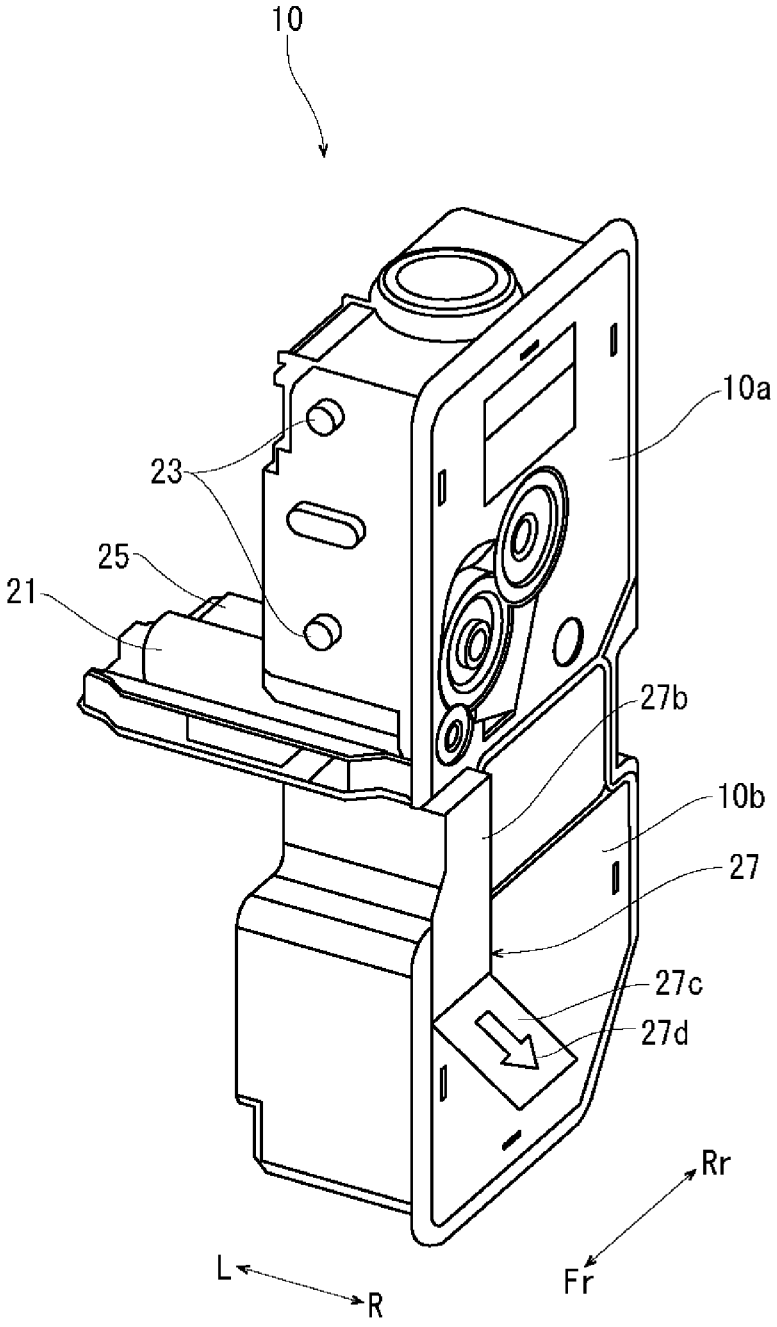
FIG. 4 is a perspective view illustrating a toner container in the color printer according to the embodiment of the present disclosure as viewed from a front side.
Figure 5:
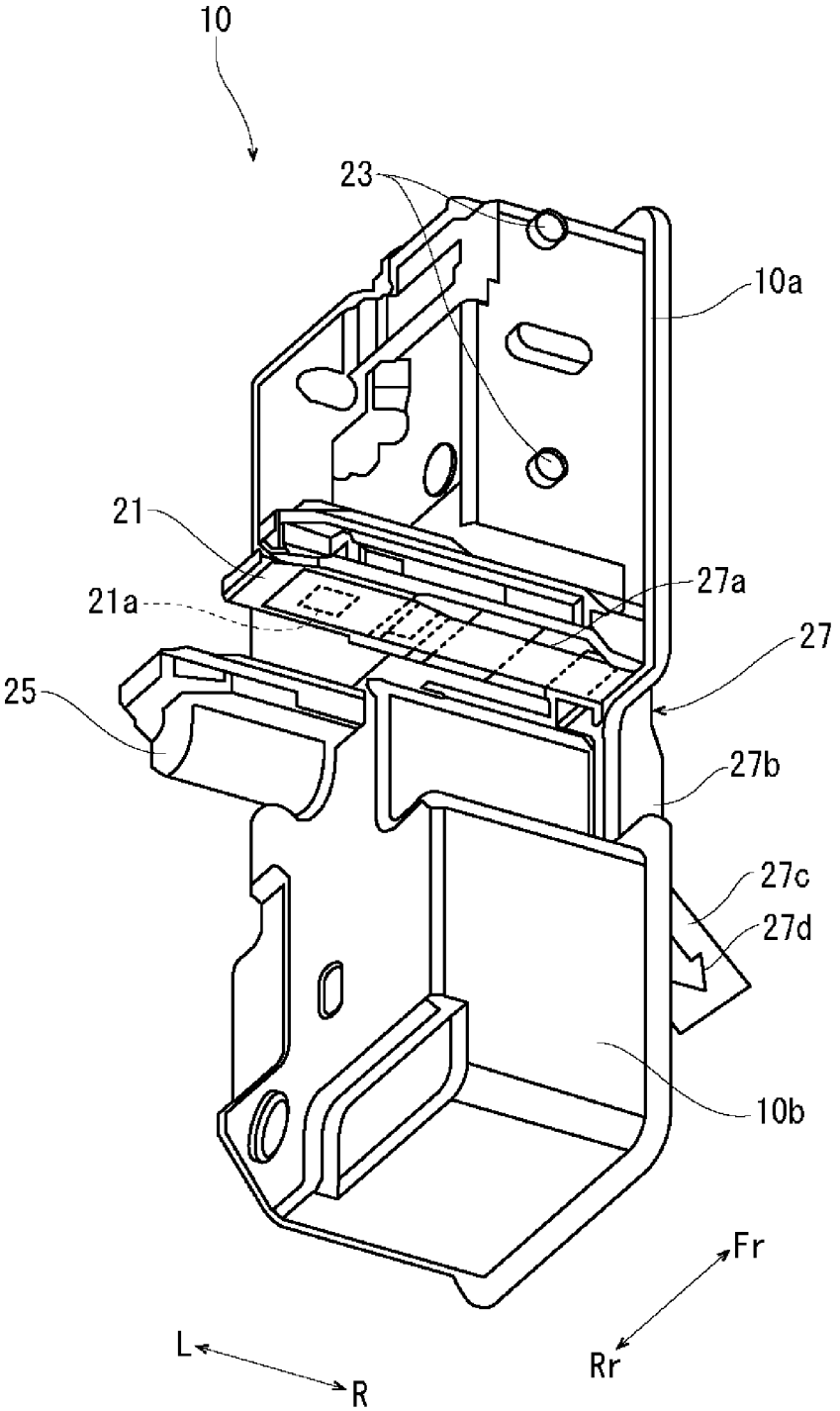
FIG. 5 is a perspective view illustrating the toner container in the color printer according to the embodiment of the present disclosure as viewed from a rear side.

First, the toner containers 10 will be described with reference to FIGS. 4 and 5. FIGS. 4 and 5 are perspective views illustrating a representative toner container 10.

The toner container 10 has a toner containing section 10*a* and a toner collecting section 10*b*. The toner containing section 10*a* is located in an upper portion of the toner container 10. The toner collecting section 10*b* is located in a lower portion of the toner container 10. The toner containing section 10*a* contains a toner to be supplied to the image forming section 3. The toner collecting section 10*b* collects waste toner from the image forming section 3. A toner replenishment duct 21 protrudes from a left surface of the toner containing section 10*a*. A lower surface of the toner replenishment duct 21 has a replenishment inlet 21*a*. The toner is supplied through the replenishment inlet 21*a*. Furthermore, two bosses 23 arranged in a vertical direction are stood on each of front and rear surfaces of the toner containing section 10*a*. A toner collection duct 25 protrudes from a left surface of the toner collecting section 10*b*. An upper surface of the toner collection duct 25 has a collection port (not shown). Waste toner is collected through the collection port.

The replenishment inlet 21*a* is sealed with a seal member 27. The seal member 27 is belt-shaped. The seal member 27 has a slide section 27*a* and a grip section 27*b*. The slide section 27*a* seals the replenishment inlet 21*a* and is slidable along the lower surface of the toner replenishment duct 21. The seal member 27 bends downward such that the grip section 27*b* extends from a right end of the slide section 27*a* along a right surface of the toner collecting section 10*b*. The grip section 27*b* bends in a diagonal upward direction to form an end section 27*c* extending from a fold line. A down-pointing arrow 27*d* is printed on the end section 27*c*.

Pulling at the grip section 27*b* rightward and downward in accordance with the down-pointing arrow 27*d* causes the slide section 27*a* to slide rightward to open the replenishment inlet 21*a*. As a result, supply of the toner from the toner container 10 to the image forming section 3 is enabled.

Figure 6:
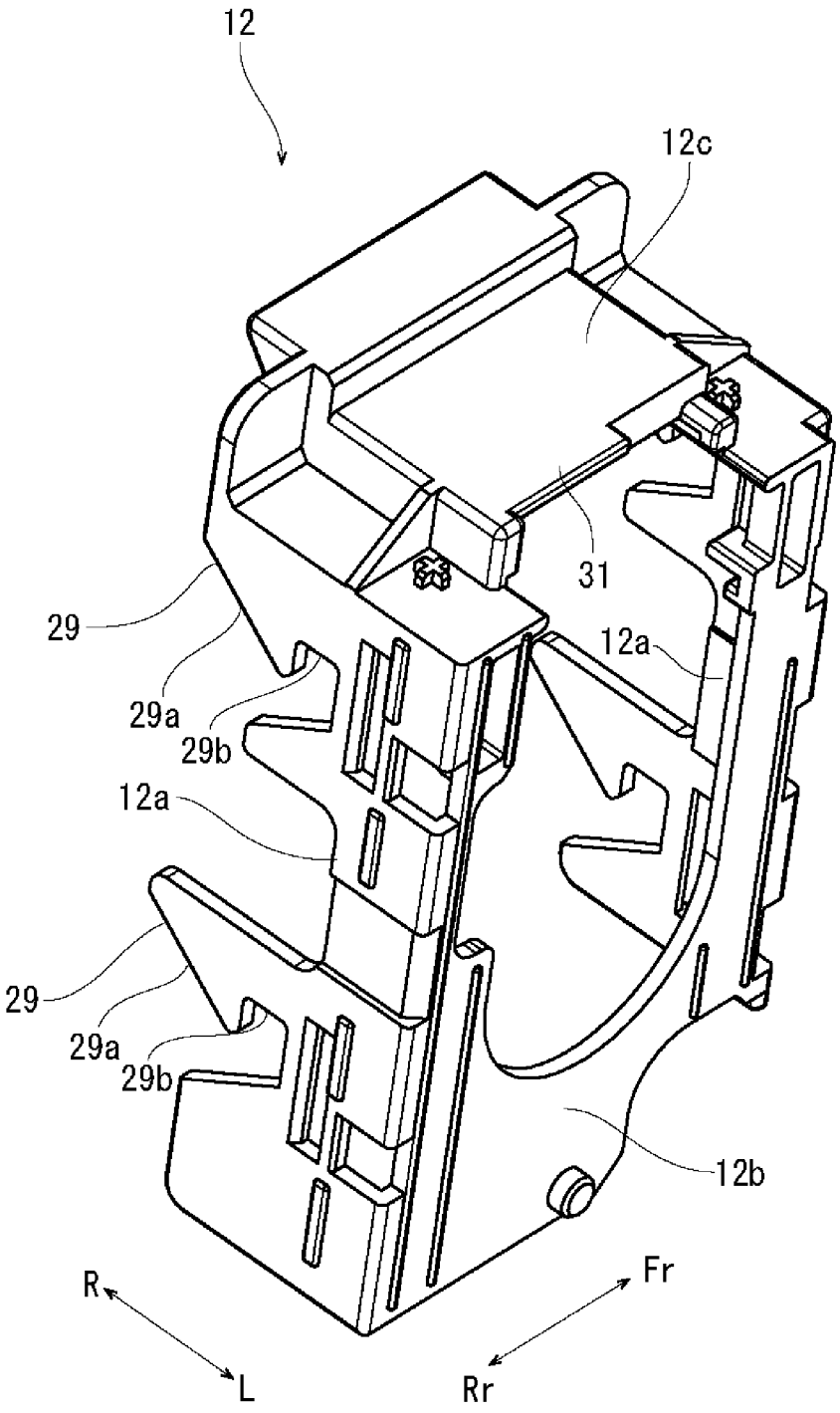
FIG. 6 is a perspective view illustrating a container holder in the color printer according to the embodiment of the present disclosure.

The following describes the container holders 12 with reference to FIG. 6. FIG. 6 is a perspective view of a representative container holder 12.

The container holder 12 has a hollow. The hollow is defined by a back plate 12*b*, an upper plate 12*c*, and opposite side plates 12*a* arranged in the front-rear direction. The hollow has the shape of a rectangular parallelepiped. The container holder 12 is open on the right side and the bottom side thereof. Each of the side plates 12*a* has two cutouts 29 arranged in the vertical direction along a side edge thereof. An upper edge of each cutout 29 has an inclined section 29*a* and a curved section 29*b*. The inclined section 29*a* is inclined in a diagonal downward direction from the side edge. The curved section 29*b* is continuous from a lower end of the inclined section 29*a* and is curved so as to form a recess upward of the lower end. The upper plate 12*c* has a protruding section 31 formed along a rear section of a left edge thereof and protruding leftward.

As illustrated in FIG. 3, the container holders 12 are adjacently arranged in the front-rear direction such that the hollows thereof face the toner container mounting aperture 2*a*. Furthermore, the container holders 12 are biased downward to an initial level by coil springs 33.

Figure 7:
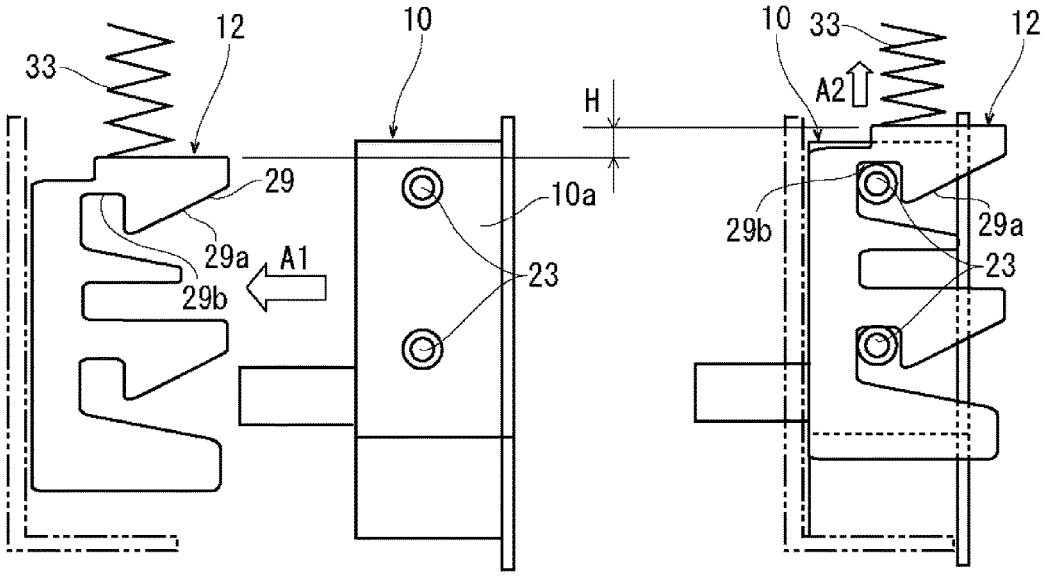
FIG. 7 is a side view illustrating vertical movement of the container holder in the color printer according to the embodiment of the present disclosure as a result of the toner container being attached thereto.

The following describes the movement of the container holder 12 when the toner container 10 is attached thereto with reference to FIG. 7. FIG. 7 is a side view illustrating the movement of the container holder 12.

The toner containing section 10*a* of the toner container 10 is fitted into the hollow of the container holder 12 (see outlined arrow A1 in FIG. 7). The bosses 23 stood on the front and rear surfaces of the toner containing section 10*a* enter the respective cutouts 29 in the side plates 12*a* of the container holder 12 and push up the container holder 12 through sliding along the respective inclined sections 29*a*. The bosses 23 engage with the respective curved sections 29*b*. Through the above, the toner container 10 is attached to the container holder 12 as illustrated in the right diagram of FIG. 7. The container holder 12 is biased downward by the coil springs 33 so that the curved sections 29*b* thereof are located downward of the corresponding bosses 23 of the toner container 10. Accordingly, the curved sections 29*b* are pushed up by the corresponding bosses 23 (see outlined arrow A2 in FIG. 7) as the bosses 23 engage with the respective curved sections 29*b*. The container holder 12 moves upward from the initial level by a distance H against biasing force of the coil springs 33.

The color printer 1 is shipped with the toner containers 10 attached thereto. The container holders 12 are therefore located at a level higher than the initial level by the distance H.

Figure 8:
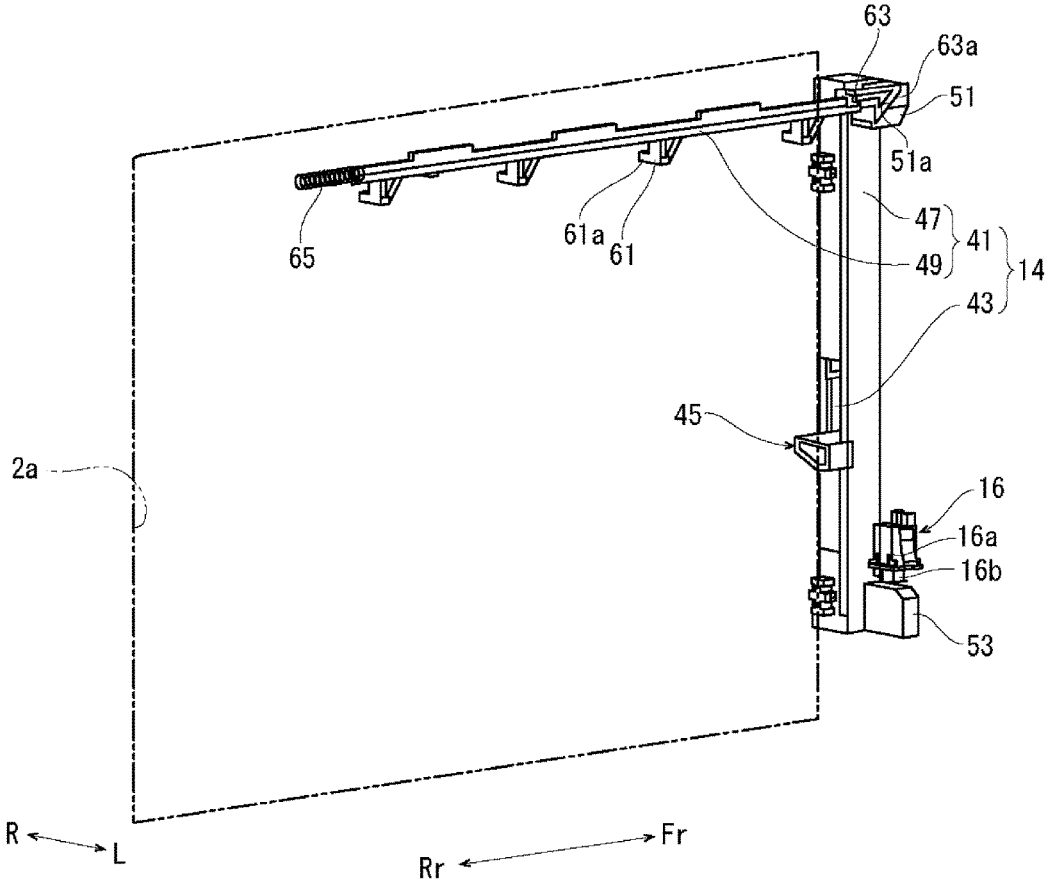
FIG. 8 is a perspective view illustrating a detector and a switching member in the color printer according to the embodiment of the present disclosure.
Figure 9A:
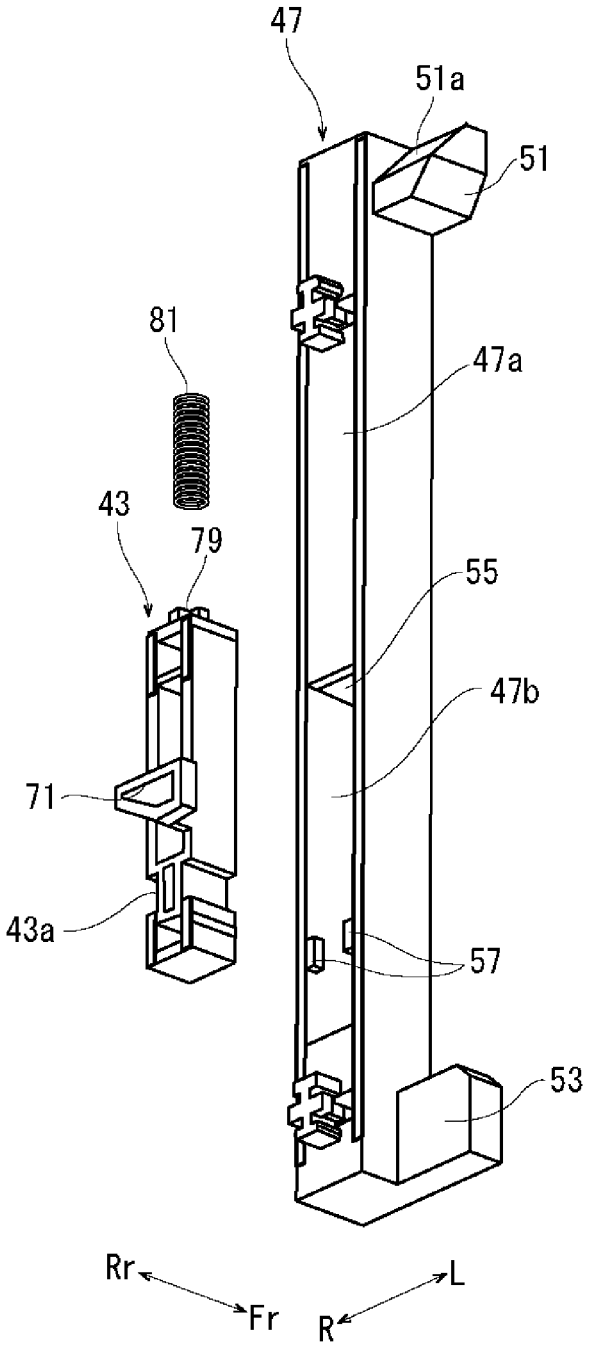
FIG. 9A is a perspective view illustrating a second switching member and a vertical slide member in the color printer according to the embodiment of the present disclosure as viewed toward an inner side of the cover.
Figure 9B:
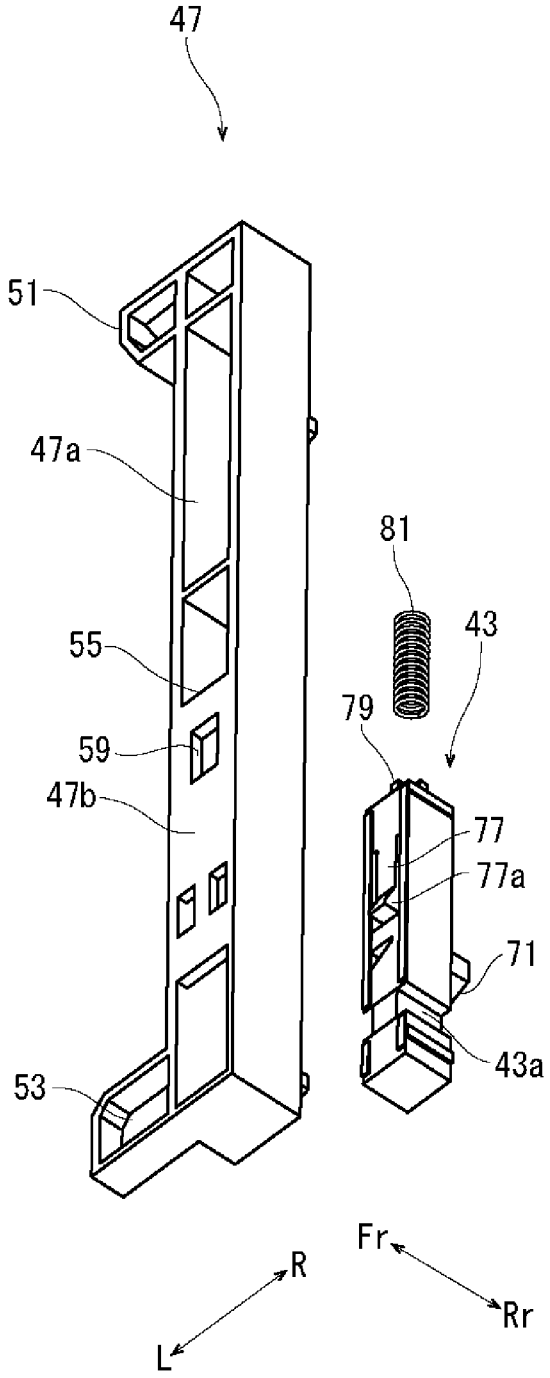
FIG. 9B is a perspective view illustrating the second switching member and the vertical slide member in the color printer according to the embodiment of the present disclosure as viewed toward an outer side of the cover.
Figure 10:
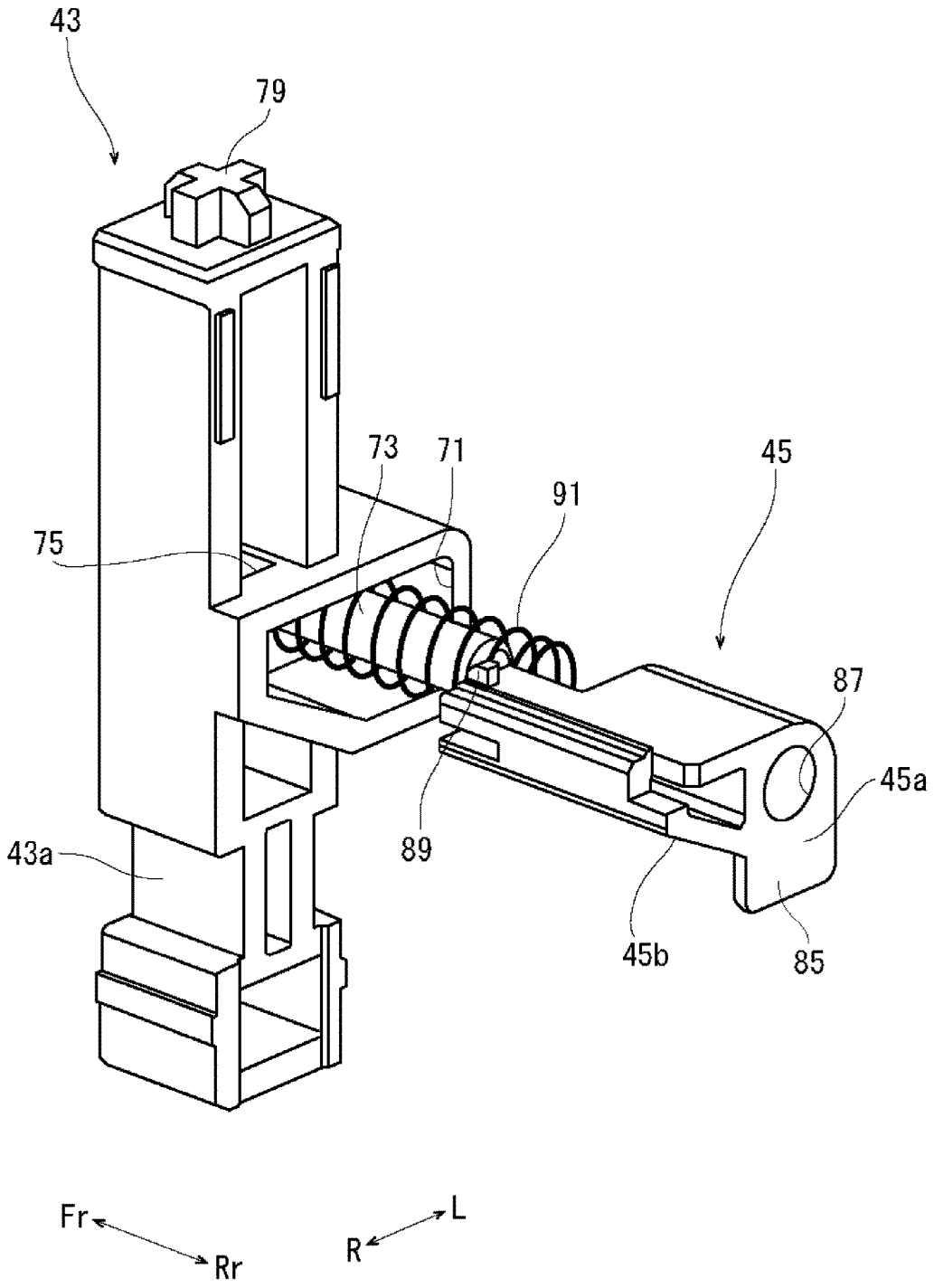
FIG. 10 is a perspective view illustrating the second switching member and a cooperating member in the color printer according to the embodiment of the present disclosure.

The following describes the switching member 14 with reference to FIGS. 8, 9A, 9B, and 10. FIG. 8 is a perspective view of the switching member. FIGS. 9A and 9B are perspective views of a first switching member and a second switching member. FIG. 10 is a perspective view of the second switching member and a cooperating member.

As illustrated in FIG. 8, the switching member 14 includes a first switching member 41, a second switching member 43, and a cooperating member 45. The first switching member 41 is disposed between the detector 16 and the container holders 12 (not shown in FIG. 8). The second switching member 43 is disposed between the first switching member 41 and the cover 7 (not shown in FIG. 8). The cooperating member 45 moves to an activated position when the cover 7 is opened for the first time. In the activated position, the cooperating member 45 is enabled to cooperate with the cover 7.

The first switching member 41 has a vertical slide member 47 and a horizontal slide member 49. The vertical slide member 47 is supported so as to be slidable in the vertical direction along a front edge of the toner container mounting aperture 2*a*. The horizontal slide member 49 is supported so as to be slidable in the left-right direction along an upper edge of the toner container mounting aperture 2*a*.

As illustrated in FIGS. 9A and 9B, the vertical slide member 47 has a hollow square cylindrical shape elongated in the vertical direction. The vertical slide member 47 has an upper pushing section 51 and a lower pushing section 53 respectively protruding from an upper section and a lower section of a left surface thereof. A rear surface of the upper pushing section 51 includes an inclined surface 51*a*, which is a rear surface inclined in a diagonal upward direction.

The vertical slide member 47 is divided by a partition wall 55 into an upper section 47*a* and a lower section 47*b*. A rear face of the lower section 47*b* has an opening. As illustrated in FIG. 9A, a pair of opposite projections 57 is formed at opposite side edges of the opening. As illustrated in FIG. 9B, a front face of the lower section 47*b* has an opening 59.

The horizontal slide member 49 has a plate shape elongated in the front-rear direction as illustrated in FIG. 8. A lower surface of the horizontal slide member 49 has downward projections 61 at locations corresponding to the respective container holders 12. Each projection 61 bends rightward to form a contact piece 61*a* at a lower end thereof. The contact piece 61*a* is located downward of the upper plate 12*c* of the corresponding container holder 12 when the toner container 10 is in the container holder 12 (i.e., when the container holder 12 is at a level higher than the initial level by the distance H). A front end of the horizontal slide member 49 has a front pushing section 63. The front pushing section 63 includes an inclined surface 63*a*, which is a front surface inclined in a diagonal downward direction. The horizontal slide member 49 is biased frontward by a coil spring 65, so that the inclined surface 63*a* of the front pushing section 63 is in contact with the inclined surface 51*a* of the upper pushing section 51 of the vertical slide member 47.

As illustrated in FIGS. 9A and 9B, the second switching member 43 has a hollow square cylindrical shape that can be contained in the lower section 47*b* of the vertical slide member 47. The second switching member 43 has a holding recess 71 that opens rearward in a middle section thereof in the vertical direction. The holding recess 71 is inverted trapezoidal as viewed from the front. As illustrated in FIG. 10, a guide pin 73 protrudes rearward from a bottom wall of the holding recess 71. A top wall of the holding recess 71 has a groove 75 extending in the front-rear direction. The second switching member 43 further has a narrow section 43*a* located downward of the holding recess 71 and having a narrowed width in the left-right direction. As illustrated in FIG. 9B, a front wall of the second switching member 43 is provided with an elastic piece 77 that is elastically deformable based on an upper end thereof. A lower end of the elastic piece 77 has a tapered pawl 77*a*. An upper surface of the second switching member 43 has a projection 79 having a cruciform cross-section.

The second switching member 43 is contained in the lower section 47*b* of the vertical slide member 47 so as to be slidable in the vertical direction. The second switching member 43 is mounted in the lower section 47*b* by passing the narrow section 43*a* of the second switching member 43 through the space between the pair of projections 57 and engaging the pawl 77*a* of the elastic piece 77 of the second switching member 43 with the opening 59. Through the above, the second switching member 43 slides in the vertical direction within the lower section 47*b*. The second switching member 43 is prevented from coming off the lower section 47*b* by the pair of projections 57.

A coil spring 81 is disposed between the second switching member 43 and the partition wall 55, allowing a loose fit with respect to the projection 79. The coil spring 81 biases the second switching member 43 downward. Biasing force of the coil spring 81 is designed to be greater than biasing force of the coil spring 65 (see FIG. 8) that biases the horizontal slide member 49 frontward.

The following describes the cooperating member 45 with reference to FIG. 10. The cooperating member 45 has a shape that can be contained in the holding recess 71 of the second switching member 43. The cooperating member 45 has a substantially vertical rear surface 45*a* and a right side surface 45*b* that is inclined in a diagonal downward direction. As described below, the rear surface 45*a* serves as a first pushed surface that is in contact with the outer surface 9*a* of the protrusion 9 of the cover 7 when the cooperating member 45 is in an inactivated position. The right side surface 45*b* serves as a second pushed surface that comes in contact with the upper tapered surface 9*b* of the protrusion 9 of the cover 7 when the cooperating member 45 is in the activated position. The rear surface 45*a* includes a downwardly extending section 85, having a vertically long rectangular shape. The cooperating member 45 also has a through hole 87 extending in the front-rear direction. The cooperating member 45 further has a pawl 89 protruding upward from an upper surface thereof.

The cooperating member 45 is supported by the holding recess 71 of the second switching member 43 so as to be slidable in the horizontal direction (front-rear direction). The guide pin 73 is inserted into the through hole 87 of the cooperating member 45, and the pawl 89 engages with the groove 75 of the holding recess 71. In such a manner, the cooperating member 45 slides in the horizontal direction along the guide pin 73 between the inactivated position, where the cooperating member 45 is contained in the holding recess 71, and the activated position, where the cooperating member 45 protrudes rearward from the holding recess 71. The cooperating member 45 in the activated position is prevented from being detached from the holding recess 71 with the pawl 89 in engagement with a rear end of the groove 75. A coil spring 91 is disposed between the holding recess 71 and the cooperating member 45 so as to surround the guide pin 73. The coil spring 91 is a biasing member that biases the cooperating member 45 toward the activated position.

The following describes the detector 16 with reference to FIG. 3. The detector 16 is a push sensor and has a main body 16*a* and a knob 16*b* protruding downward from the main body 16*a*. A closed state of the cover 7 is detected through the knob 16*b* being pushed into the main body 16*a*, and an open state of the cover 7 is detected through the knob 16*b* being released. The detector 16 is electrically connected with the controller 4. Upon a switch of the cover 7 from the open state to the closed state being transmitted to the controller 4, the controller 4 determines that image formation is enabled. Upon a switch of the cover 7 from the closed state to the open state being transmitted to the controller 4, the controller 4 determines that image formation is disabled.

The detector 16 is disposed above the lower pushing section 53 of the vertical slide member 47 with the knob 16*b* facing downward (see FIG. 8).

Figure 13:
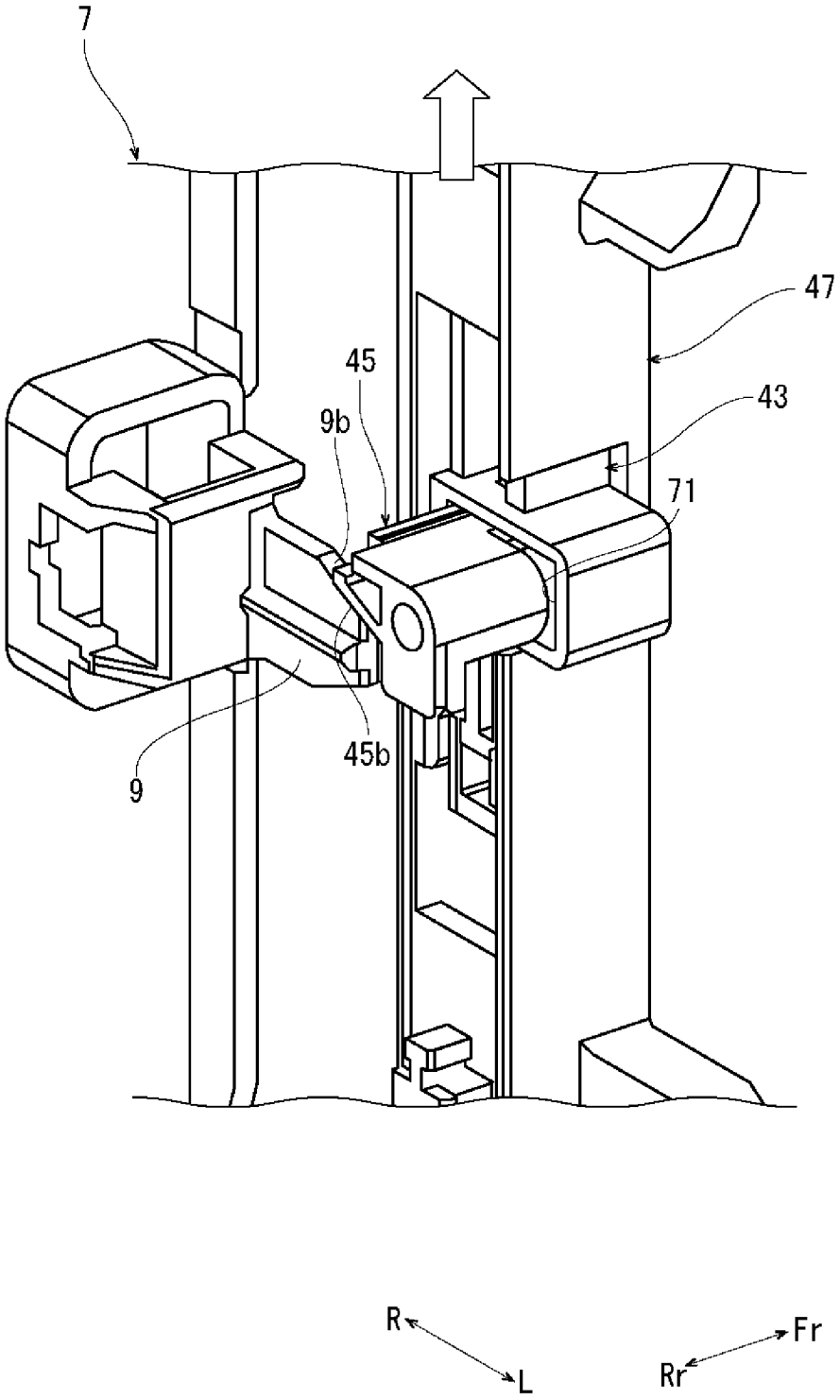
FIG. 13 is a perspective view illustrating the cooperating member in the color printer according to the embodiment of the present disclosure when the cover is closed after the cover has been opened for the first time.
Figure 14:
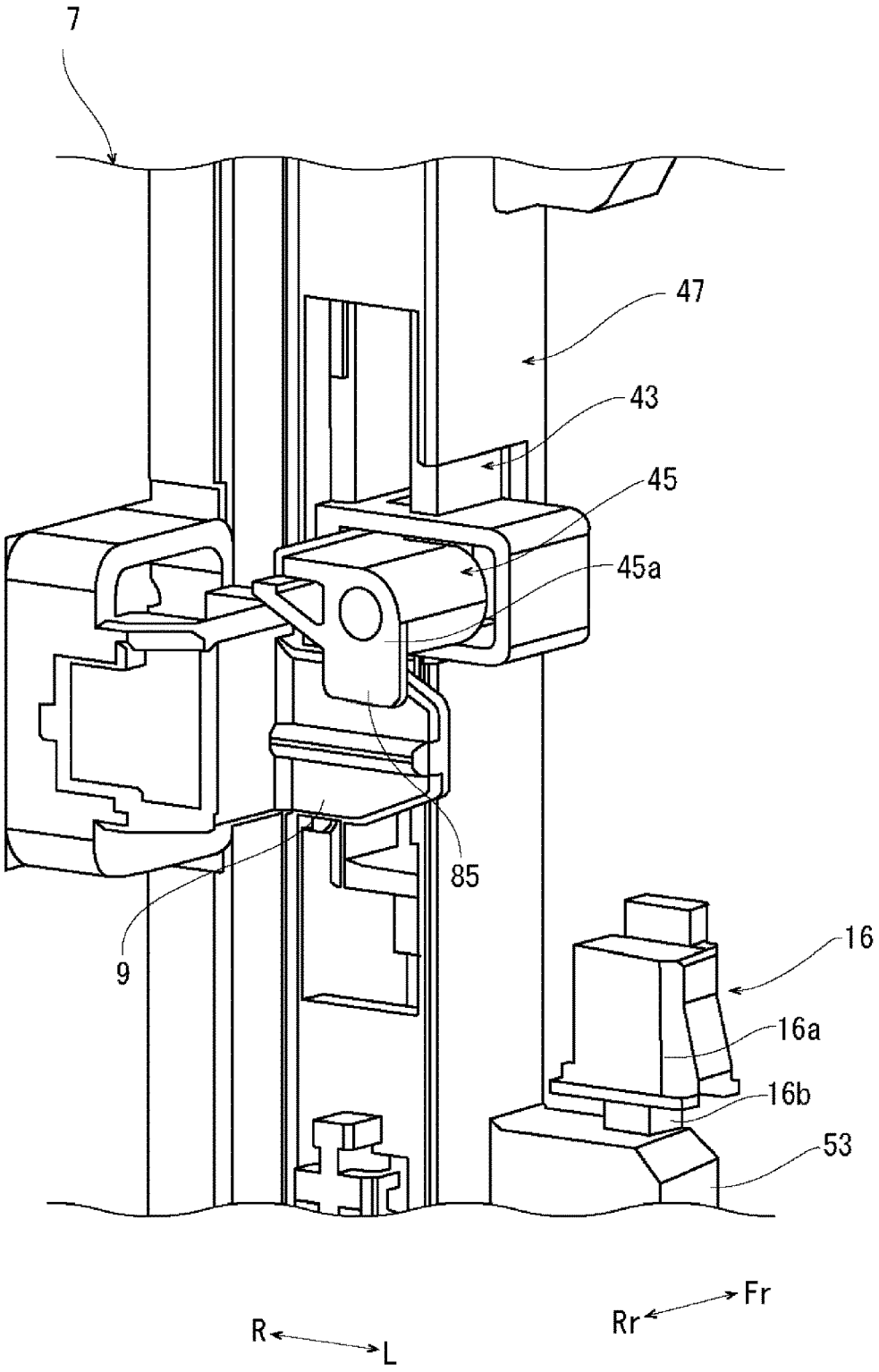
FIG. 14 is a perspective view illustrating the cooperating member in the color printer according to the embodiment of the present disclosure with the cover closed.
Figure 15A:
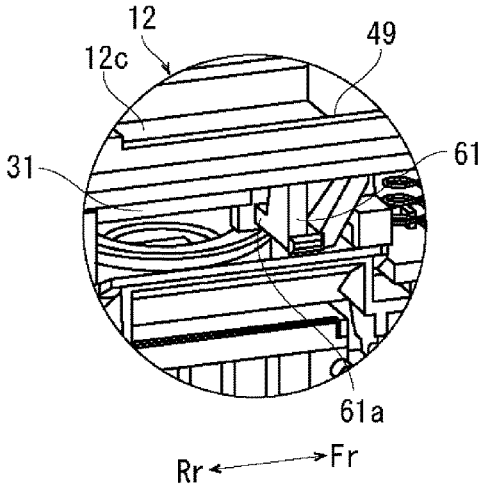
FIG. 15A is a perspective view illustrating a protrusion of the container holder with the toner container attached thereto and a contact piece of a horizontal slide member in the color printer according to the embodiment of the present disclosure.
Figure 15B:
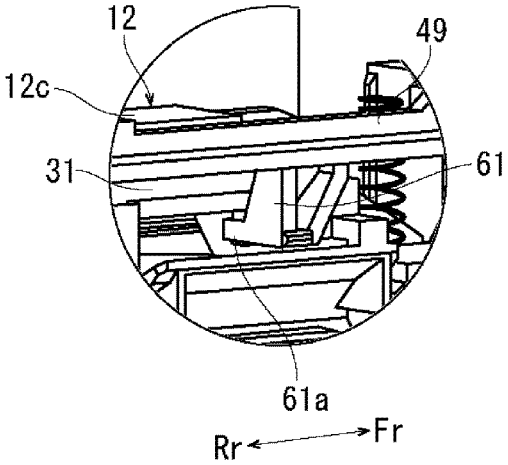
FIG. 15B is a perspective view illustrating the protrusion of the container holder with the toner container attached thereto and the contact piece of the horizontal slide member in the color printer according to the embodiment of the present disclosure with the cover closed.
Figure 15C:
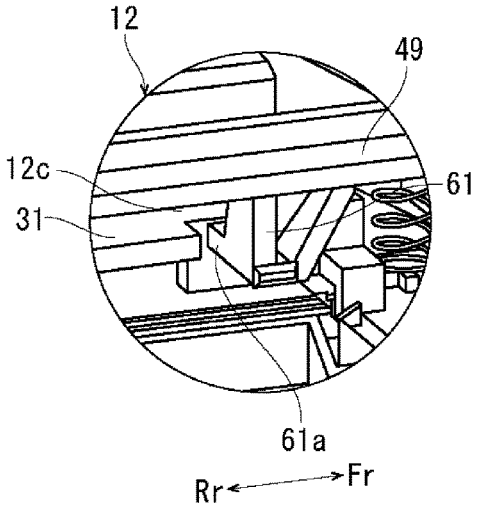
FIG. 15C is a perspective view illustrating the protrusion of the container holder without the toner container attached thereto and the contact piece of the horizontal slide member in the color printer according to the embodiment of the present disclosure.

The following describes opening and closing of the cover 7 of the color printer 1 having the above-described configuration with reference to FIGS. 11 to 14 and 15A to 15C. FIGS. 11 to 14 are perspective views each illustrating the cooperating member 45 when the cover 7 is opened. FIGS. 15A to 15C are perspective views each illustrating positional relationship between the horizontal slide member 49 and the container holder 12.

The color printer 1 is shipped with all the toner containers 10 attached to the respective container holders 12. The toner container mounting aperture 2*a* is closed by the cover 7. In such a state for shipping, as illustrated in FIG. 8, the horizontal slide member 49 is biased frontward by the coil spring 65, and the inclined surface 51*a* of the upper pushing section 51 of the vertical slide member 47 is pushed by the inclined surface 63*a* of the front pushing section 63. The vertical slide member 47 is biased downward, and thus the lower pushing section 53 is in a lower position to be spaced from the knob 16*b* of the detector 16. As illustrated in FIG. 15A, each container holder 12 is at the higher level with the upper plate 12*c* (including the protruding section 31) located upward of the corresponding contact piece 61*a* of the horizontal slide member 49.

Figure 11:
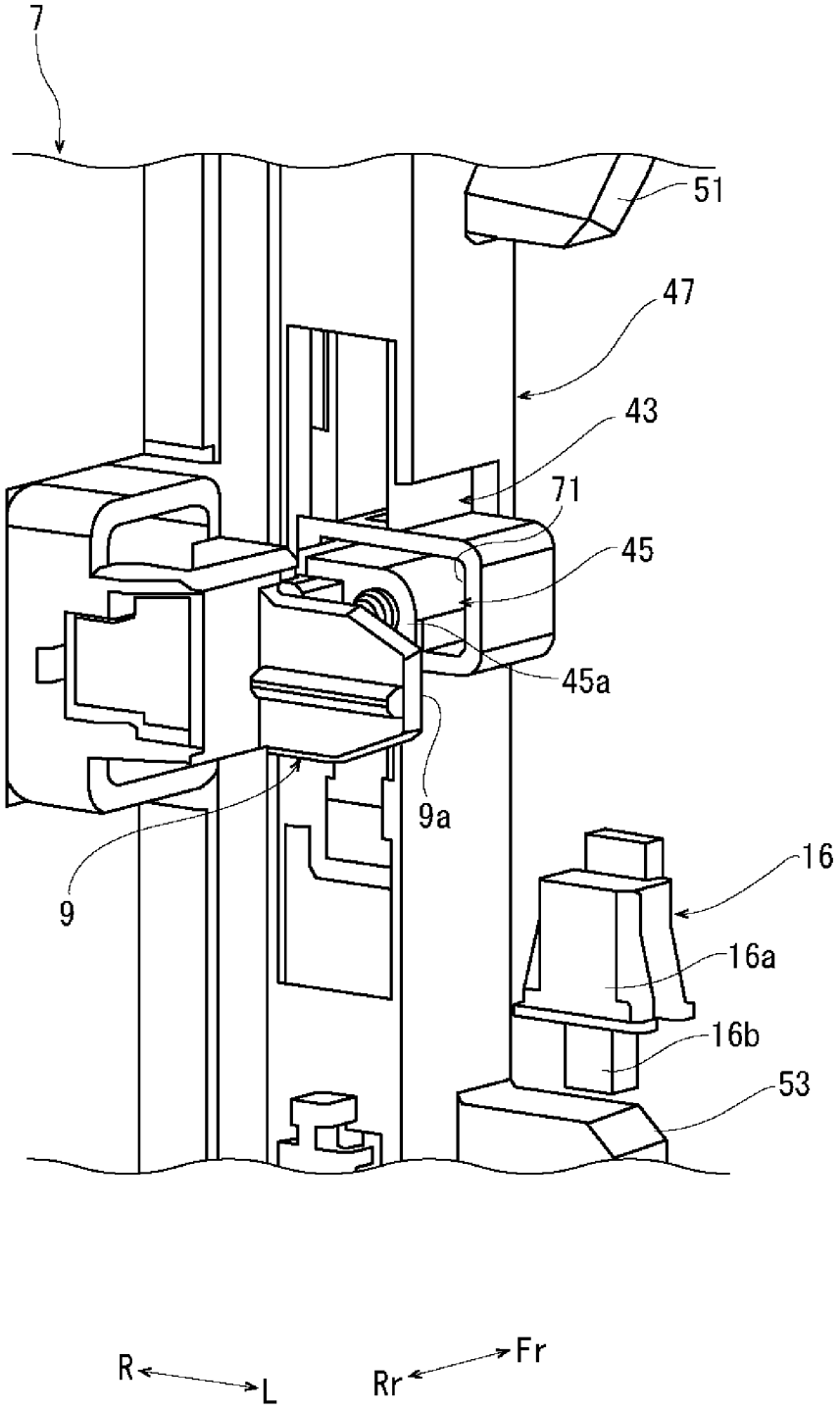
FIG. 11 is a perspective view illustrating the cooperating member in the color printer according to the embodiment of the present disclosure with the cover closed.

As illustrated in FIG. 11, the cooperating member 45 is kept retracted in the inactivated position against biasing force of the coil spring 91 with the rear surface 45*a* of the cooperating member 45 being pushed by the outer surface 9*a* of the protrusion 9 of the cover 7. The rear surface 45*a* of the cooperating member 45 has a relatively large area, and thus the cooperating member 45 is supported in the inactivated position in a stable manner by the outer surface 9*a* of the protrusion 9.

Figure 12:
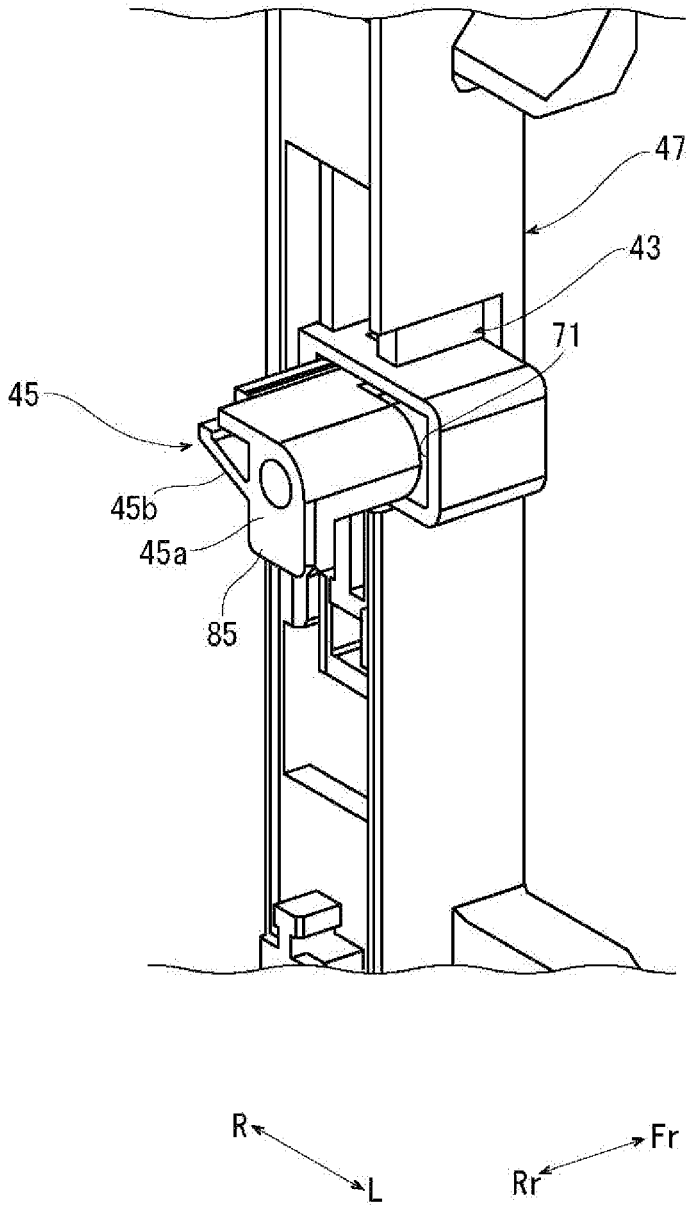
FIG. 12 is a perspective view illustrating the cooperating member in the color printer according to the embodiment of the present disclosure after the cover is opened for the first time.

When the cover 7 is opened for the first time after delivery of the color printer 1, the rear surface 45*a* of the cooperating member 45 separates from the outer surface 9*a* of the protrusion 9, and the cooperating member 45 is biased by the coil spring 91 toward the activated position to protrude into the toner container mounting aperture 2*a* as illustrated in FIG. 12.

When the cover 7 is closed after the cover 7 has been opened for the first time, the protrusion 9 of the cover 7 interferes with the cooperating member 45 biased into the activated position as illustrated in FIG. 13. Specifically, an end of the protrusion 9 comes under the right side surface 45*b* of the cooperating member 45, and the upper tapered surface 9*b* of the protrusion 9 comes in contact with the right side surface 45*b* to exert force to push up the cooperating member 45. This upward force is exerted on the second switching member 43 and the vertical slide member 47 as well as the cooperating member 45. Since the inclined surface 51*a* of the upper pushing section 51 of the vertical slide member 47 is in contact with the inclined surface 63*a* of the front pushing section 63 of the horizontal slide member 49, rearward force is exerted on the inclined surface 63*a*. The rearward force is exerted on the horizontal slide member 49 against biasing force of the coil spring 65.

It should be noted here that biasing force of the coil spring 81 that biases the second switching member 43 is greater than biasing force of the coil spring 65 that biases the horizontal slide member 49 frontward. Consequently, the coil spring 65 that biases the horizontal slide member 49 compresses rather than the coil spring 81 that biases the second switching member 43 when the right side surface 45*b* of the cooperating member 45 is pushed upward by the protrusion 9 of the cover 7. As a result, the horizontal slide member 49 slides rearward, and the vertical slide member 47 slides upward together with the second switching member 43 as indicated by an outlined arrow in FIG. 13.

Thus, the lower pushing section 53 of the vertical slide member 47 pushes in the knob 16*b* of the detector 16 as illustrated in FIG. 14. As a result, the detector 16 detects the closed state of the cover 7. When the cover 7 is completely closed, an upper surface of the protrusion 9 comes in contact with a lower surface of the cooperating member 45. The second switching member 43 containing the cooperating member 45 is biased downward by the coil spring 81, and this biasing force keeps the cooperating member 45 and the protrusion 9 of the cover 7 in contact with each other. That is, the cover 7 is kept in the closed state. Even if the cover 7 moves in the front-rear direction, the extending section 85 of the cooperating member 45 prevents the protrusion 9 from separating from the cooperating member 45.

The horizontal slide member 49 sliding rearward is accompanied by each contact piece 61*a* of the horizontal slide member 49 moving to a position under the protruding section 31 of the upper plate 12*c* of the corresponding container holder 12 as illustrated in FIG. 15B.

Once the cover 7 is opened for the first time after delivery of the color printer 1 and the cooperating member 45 protrudes into the activated position, the cooperating member 45 is continually kept in the activated position.

The following describes closing of the cover 7 when at least one of the toner containers 10 is not in place. As described above, the container holder 12 without the toner container 10 attached thereto is at the initial level, being biased downward by the coil springs 33. Accordingly, the protruding section 31 of the upper plate 12*c* of this container holder 12 is at the same level as the corresponding contact piece 61*a* of the horizontal slide member 49 as illustrated in FIG. 15C.

When the cover 7 is closed in such a situation, the protrusion 9 exerts force to push up the second switching member 43 and the vertical slide member 47 as well as the cooperating member 45, and cause the horizontal slide member 49 to slide rearward.

However, the protruding section 31 of the container holder 12 without the toner container 10 attached thereto is at the same level as the corresponding contact piece 61*a* of the horizontal slide member 49 as illustrated in FIG. 15C. The contact piece 61*a* therefore engages with the protruding section 31 of the container holder 12 to restrict rearward sliding of the horizontal slide member 49. As a result of the horizontal slide member 49 being restricted from sliding in such a manner, upward sliding of the vertical slide member 47 is also restricted. Consequently, the knob 16*b* of the detector 16 is not pushed in, and the closed state of the cover 7 is not detected. As described above, the controller 4 does not determine that image formation is enabled when the cover 7 is closed while at least one of the toner containers 10 is not in place.

However, the protrusion 9 keeps pushing the cooperating member 45 upward even while upward sliding of the vertical slide member 47 is restricted. The second switching member 43 therefore slides upward relative to the vertical slide member 47 against biasing force of the coil spring 81. The coil spring 81 keeps the cooperating member 45 and the protrusion 9 in contact with each other, maintaining the closed state of the cover 7.

The replenishment inlet 21*a* of each toner container 10 is sealed with the seal member 27 as illustrated in FIGS. 4 and 5 at the time of shipping of the color printer 1. The seal member 27 needs to be removed in order to execute an image formation operation. The color printer 1 according to the present embodiment is provided with an operation guide label 100 to prevent a failing to remove the seal members 27.

The following describes the operation guide label 100 with reference to FIGS. 1 and 2.

As illustrated in FIG. 2, the operation guide label 100 has a first label section 100*a*, a second label section 100*b*, and a link section 100*c* linking the first and second label sections 100*a* and 100*b*. The operation guide label 100 has an adhesive inner surface. The first label section 100*a* has a rectangular shape dimensioned to cover the power switch 5 of the main body 2. The second label section 100*b* has a rectangular shape dimensioned to cover right surfaces of the toner collecting sections 10*b* of all the toner containers 10 attached to the container holders 12. Outer surfaces of the first and second label sections 100*a* and 100*b* show a message that prompts removal of the operation guide label 100 and the seal members 27, and a message that explains how to remove the seal members 27. The messages are for example in the form of text, picture, or a combination thereof.

The first label section 100*a* is attached to an area surrounding the power switch 5. The second label section 100*b* is attached to the right surfaces of the toner collecting sections 10*b* of all the toner containers 10.

When a user is to press the power switch 5 after delivery of the color printer 1 provided with such an operation guide label 100, the user cannot see the power switch 5 because the power switch 5 is covered with the operation guide label 100. The user finds the operation guide label 100 in the course of search for the power switch 5 and decides to remove the operation guide label 100. The user opens the cover 7, because it is necessary to open the cover 7 in order to completely remove the operation guide label 100. In accordance with the message on the removed operation guide label 100 that prompts removal of the seal members 27, the user removes the seal members 27 to open the replenishment inlets 21*a*. As a result of the cover 7 being opened for the first time, the cooperating member 45 is biased into the activated position.

The cover 7 is then closed. The switching member 14 moves in cooperation with the cover 7 through the cooperating member 45 as described above, and thus the detector 16 detects the closed state of the cover 7. Through the above, the controller 4 determines that image formation is enabled.

If the user presses the power switch 5 after removing only the first label section 100*a* to expose the power switch 5 instead of completely removing the operation guide label 100, that is, before first opening the cover 7, the detector 16 does not detect the closed state of the cover 7. As a result, the controller 4 does not determine that image formation is enabled. That is, the controller 4 does not allow execution of image formation unless the seal members 27 are removed.

In such a situation, the user wonders why and looks to the operation guide label 100. The operation guide label 100 has the message that prompts removal of the seal members 27. In accordance with the message, the user opens the cover 7 to remove the operation guide label 100, and then removes the seal members 27. As a result of the cover 7 being opened, the cooperating member 45 is biased into the activated position as described above. The cover 7 is then closed. The switching member 14 moves in cooperation with the cover 7 through the cooperating member 45 biased into the activated position as described above, and thus the detector 16 detects the closed state of the cover 7. Through the above, the controller 4 determines that image formation is enabled.

As described above, the color printer 1 according to the embodiment of the present disclosure does not allow execution of an image formation operation unless the cover 7 is opened once after the shipping thereof, requiring that the cover 7 be opened. Thus, according to the present embodiment, it is possible to prevent a failure to remove the seal members 27.

According to the present embodiment, the cooperating member 45 is kept retracted in the inactivated position by the protrusion 9 of the cover 7 during the shipping. Opening the cover 7 for the first time separates the protrusion 9 from the cooperating member 45. Thus, it is possible to automatically bias the cooperating member 45 into the activated position using the coil spring 91.

According to the present embodiment, the cover 7 can have a simplified configuration because the protrusion 9 of the cover 7 has both a function to keep the cooperating member 45 retracted in the inactivated position and a function to move the switching member 14 through contact with the cooperating member 45 in the activated position.

According to the present embodiment, the protrusion 9 of the cover 7 has the substantially vertical outer surface 9*a* intersecting with the horizontal direction, which is a pivoting direction of the cover 7. The protrusion 9 of the cover 7 also has the tapered surface 9*b* inclined downward in the closing direction of the cover 7. The cooperating member 45 has the rear surface 45*a* that is in contact with the outer surface 9*a* of the protrusion 9 when the cooperating member 45 is in the inactivated position. The cooperating member 45 also has the right side surface 45*b* that comes in contact with the tapered surface 9*b* of the protrusion 9 when the cooperating member 45 is in the activated position. The above-described configuration allows the outer surface 9*a* to have the function to keep the cooperating member 45 retracted in the inactivated position by pushing the cooperating member 45 movable in the horizontal direction. The above-described configuration also allows the tapered surface 9*b* to have the function to move the switching member 14 through the cooperating member 45 in the activated position when the cover 7 is closed.

According to the present embodiment, it is possible to detect the closed or open state of the cover 7 and whether or not the toner containers 10 are attached to the container holders 12 using one detector 16. Such a configuration does not require an additional sensor, preventing a cost increase. Particularly, in the case of a full-color image forming apparatus, which has a plurality of the toner containers 10, it is possible to detect whether or not all the toner containers 10 are in place using one detector 16.

According to the present embodiment, the container holders 12 function as movable members that move in a specific direction as a result of the toner containers 10 being attached thereto. Movement of the switching member 14 to a direction for causing the detector 16 to detect the closed state of the cover 7 is permitted or restricted depending on presence or absence of movement of the container holders 12. Thus, the controller 4 does not determine that image formation is enabled even if the cover 7 is closed, so long as the toner containers 10 are not in place.

Note that the protrusion 9 keeps pushing the cooperating member 45 upward even while upward sliding of the vertical slide member 47 is restricted. As a result, the second switching member 43 slides upward relative to the vertical slide member 47 against biasing force of the coil spring 81. The coil spring 81 keeps the cooperating member 45 and the protrusion 9 in contact with each other. Thus, the cover 7 is kept in the closed state.

The above-described configuration allows the cover 7 to be closed without the detector 16 detecting the closed state of the cover 7 when any of the toner containers 10 is not in place. For example, the color printer 1 may be transported without the toner containers 10 attached thereto for some reason such as maintenance. In a configuration in which the cover 7 cannot be closed unless the toner containers 10 are in place, the color printer 1 may be transported with the cover 7 open, which is inconvenient. According to the present embodiment, however, the cover 7 can be closed without the detector 16 detecting the closed state of the cover 7 when any of the toner containers 10 is not in place. As a result, the color printer 1 is easy to handle.

According to the present embodiment, the container holders 12 are used as movable members that move in a specific direction as a result of the toner containers 10 being attached thereto. Alternatively, incompatible shape determination members that determine an incompatible shape of the respective toner containers 10 may be used. In such a configuration, each incompatible shape determination member may be allowed to move in a specific direction when the corresponding toner container 10 is attached in a regular manner and may be restricted from moving when the toner container 10 is attached in an irregular manner.

Description of an embodiment of the present disclosure is given above to explain a preferred embodiment of the image forming apparatus according to the present disclosure and may therefore involve various technically preferable limitations. However, the technical scope of the present disclosure is not limited to such an embodiment unless otherwise stated. Elements of configuration of the above-described embodiment of the present disclosure can be replaced or combined with existing elements or components as appropriate to implement various alternations. The claims are not limited by the description of an embodiment of the present disclosure given above.

What is claimed is:

1. An image forming apparatus comprising:

a cover configured to open and close an aperture in a main body of the image forming apparatus;

a cooperating member configured to move to an activated position when the cover is opened for the first time after delivery of the image forming apparatus, the activated position being a position where the cooperating member is enabled to cooperate with the cover;

a switching member configured to move in cooperation with the cover through the cooperating member in the activated position as the cover is opened and closed;

a detector configured to detect an open state or a closed state of the cover according to the movement of the switching member; and a controller configured to determine that image formation is enabled when the detector has detected the closed state of the cover, wherein the cooperating member is movable between an inactivated position where the cooperating member is contained in the switching member and the activated position where the cooperating member protrudes from the switching member into the aperture, and the image forming apparatus further comprises:

a biasing member configured to bias the cooperating member in a direction from the inactivated position to the activated position; and a protrusion provided on the cover and configured to keep the cooperating member retracted in the inactivated position against biasing force of the biasing member before the cover is opened for the first time after delivery of the image forming apparatus.

2. The image forming apparatus according to claim 1, wherein the protrusion moves the switching member when the cover is opened and closed through contact with the cooperating member in the activated position.

3. The image forming apparatus according to claim 2, wherein the cover is pivotable in a horizontal direction, the switching member is movable in a vertical direction, the cooperating member is movable in the horizontal direction between the inactivated position and the activated position, the protrusion has:

a first pushing surface extending in a direction intersecting with a pivoting direction of the cover; and a second pushing surface inclined in a closing direction of the cover, the cooperating member has:

a first pushed surface configured to be in contact with the first pushing surface of the protrusion when the cooperating member is in the inactivated position; and a second pushed surface configured to come in contact with the second pushing surface of the protrusion when the cooperating member is in the activated position, the first pushing surface of the protrusion pushes the first pushed surface of the cooperating member to keep the cooperating member retracted in the inactivated position before delivery of the image forming apparatus, when the cover is opened for the first time after delivery of the image forming apparatus, the first pushing surface of the protrusion separates from the first pushed surface of the cooperating member and the biasing member biases the cooperating member into the activated position, and when the cover is closed after the cover has been opened for the first time, the second pushing surface of the protrusion comes in contact with the second pushed surface of the cooperating member biased into the activated position to push the cooperating member in the vertical direction and move the switching member in the vertical direction with the cooperating member.

4. An image forming apparatus comprising:

a cover configured to open and close an aperture in a main body of the image forming apparatus;

a cooperating member configured to move to an activated position when the cover is opened for the first time after delivery of the image forming apparatus, the activated position being a position where the cooperating member is enabled to cooperate with the cover;

a switching member configured to move in cooperation with the cover through the cooperating member in the activated position as the cover is opened and closed;

a detector configured to detect an open state or a closed state of the cover according to the movement of the switching member; and a controller configured to determine that image formation is enabled when the detector has detected the closed state of the cover, wherein the aperture is a toner container mounting aperture through which a toner container is attached and detached, the image forming apparatus further comprises a movable member supported so as to move in a specific direction as a result of the toner container being attached thereto, when the cover is closed with the toner container attached to the movable member, the movable member permits the switching member to move in a direction for causing the detector to detect the closed state of the cover, and when the cover is closed without the toner container attached to the movable member, the movable member restricts the switching member from moving in the direction for causing the detector to detect the closed state of the cover.

* * * * *